United States Patent [19]

Wood

[11] Patent Number: 4,606,406

[45] Date of Patent: Aug. 19, 1986

[54] INFLATABLE PACKER COMPATIBLE WITH CBL

[75] Inventor: Edward T. Wood, Kingwood, Tex.

[73] Assignee: Completion Tool Company, Houston, Tex.

[21] Appl. No.: 695,538

[22] Filed: Jan. 28, 1985

[51] Int. Cl.[4] ..... E21B 33/127

[52] U.S. Cl. ..... 166/187; 277/34

[58] Field of Search ..... 166/187, 179; 277/34.6, 277/34, 34.3

[56] References Cited

U.S. PATENT DOCUMENTS

| | | | |
|---|---|---|---|
| 3,604,732 | 9/1971 | Malone | 277/34 X |
| 3,821,340 | 6/1974 | Marks | 277/34 X |
| 3,837,947 | 9/1974 | Malone | 277/34 X |
| 4,311,314 | 1/1982 | Suman | 166/187 X |
| 4,349,204 | 9/1982 | Malone | 277/34 |
| 4,421,165 | 12/1983 | Szarka | 166/187 X |

*Primary Examiner*—Stephen J. Novosad
*Assistant Examiner*—David J. Bagnell

[57] ABSTRACT

An inflatable packer with a supporting mandrel having intermittent coatings of grit-like materials bonded to the mandrel to provide a frictional contact surface for an inflatable rubber sleeve with intermittent bare portions thereby to permit use of a cement bond logging tool, the spacings of the coatings being functionally related to the transmitter/receiver spacing of a cement bond logging tool.

3 Claims, 3 Drawing Figures

INFLATABLE PACKER COMPATIBLE WITH CBL

FIELD OF THE INVENTION

The present invention relates to inflatable packers for use during the drilling or production of oil and gas wells for the purpose of providing an annular seal between the outside of the pipe string and the surrounding surface such as a borehole wall or the inner surface of a larger pipe. More particularly, the present invention relates to inflatable packers having inflatable elastomer sleeves usually of 5 to 40 feet in length for inflation in a wellbore by means of a cement slurry introduced during the cementing operation.

BACKGROUND OF THE INVENTION

Inflatable rubber or elastomer sleeve type packers having a relatively short length elastomer sleeve have been in use for many years. The elastomer sleeve of this type of packer has reinforcing ribs which extend continuously along the length of the sleeve. The reinforcing ribs, inter alia, are incorporated into the sleeve and prevent any portion of the sleeve from moving axially with respect to its supporting mandrel while the packer is being run into the wellbore on a string of pipe. However, as the length of the sleeve and supporting mandrel or pipe has increased to provide extended length inflatable packers up to forty feet in length (a common length of pipe), the use of continuous ribs along the length of the sleeve is impractical. As a result the central portions of the sleeve do not have any support ribs and the unsupported sleeve has a tendency to move axially with respect to its supporting mandrel while the packer is being run into the well. This can result in failure of the sleeve and therefore subsequent loss of the sealing and anchoring ability of the packer when expansion of the sleeve is attempted. When damage to the sleeve occurs, the pipe string may have to be retrieved before the cementing operation to replace the packer which involves expensive delays in the drilling and completion of oil and gas wells.

Movement of the sleeve axially with respect to its supporting mandrel before the inflation of sleeve may be caused by several factors; i.e., the string of pipe which includes the packer may move laterally against the side of the borehole causing frictional contact of the sleeve with the borehole; the borehole may not be straight causing frictional contact of the sleeve with the borehole, the borehole may have cuttings stacked within it so as to force the sleeve on the string of pipe to contact the borehole wall; or the supporting mandrel in the string of pipe may be in compression and cause the sleeve to frictionally contact the borehole wall. Any one of the above factors when occurred in a wellbore can cause axial movement between the sleeve and its supporting mandrel before the packer is at its desired location and inflated. The axial movement can cause the sleeve to tear away and prevent it from providing its intended function of sealing and anchoring against the borehole. The tendency for a long sleeve to slide along the mandrel is much greater than for a short sleeve because of the longer length of contact between the sleeve and borehole and also because the sleeve lacks supporting ribs in its midsection.

Where the supporting mandrel in the string of pipe has a smooth outer surface, the contact of the sleeve of the borehole wall may develop a greater frictional force on the sleeve than the frictional force tending to hold the sleeve to a smooth mandrel.

One solution to the problem is presented in U.S. Pat. No. 4,311,314 dissued to George O. Suman. This patent discloses that a layer of material having a rough surface can be interposed between the steel supporting mandrel and the rubber sleeve. The rough surface material is formed by bonding solid grit-like particles (sand, metal or the like) to the mandrel surface by a suitable binder such as an epoxy resin. The rough surface of the epoxy impregnated bonding material provides for increased friction on the surface contacting the sleeve and therefore improves the frictional relationship of the sleeve relative to the supporting mandrel so that the sleeve is less likely to move axially with respect to the supporting mandrel. However, the addition of the epoxy and grit-like material to the supporting mandrel affects the acoustical transmission properties of the supporting mandrel. Thus, when a packer is inflated in the well into sealing contact with the wellbore and a cement bond logging or log (CBL) tool is run through the pipe to obtain a cement bond log, it has been found that the amplitude of the sonic signal on the CBL log obtained by the CBL tool is increased, which typically indicates a lack of bonding of cement at the interfaces between the cement and the borehole and mandrel. This increase in amplitude, however, is an erroneous representation because the amplitude of the sonic signal is affected by the epoxy and grit-like material. Therefore, a customer has an uncertainty about the bonding of the cement at the interfaces along the packer.

In an effort to solve the problem of the effects of the epoxy impregnated bonded material to the CBL logs and to obtain sufficient frictional coefficients between the mandrel and the midportion of a rubber sleeve, there is disclosed in U.S. application Ser. No. 460,313 filed Jan. 24, 1983 by William T. Bell et al, an inflatable packer wherein the supporting mandrel is grooved or knurled along its length to provide roughness between the mandrel and the sleeve. The rough surface of the mandrel enhances the ability of the packer to survive the trip in the wellbore without movement of the sleeve relative to its supporting mandrel. When the packer is inflated in the wellbore there is no epoxy material to adversely affect the results obtained by a CBL log with a CBL tool. However, the cost of knurling and of preparing the mandrel as such within the wall thickness standards required a pipe is expensive and the degree of frictional contact between a sleeve and a metal roughened mandrel is not necessarily as great as can be obtained by an epoxy grit material.

The present invention involves the use of a specially prepared mandrel for supporting the elastomer sleeve in which the advantages of the epoxy rough coating are retained and the adverse effects of the epoxy rough coating to the logs obtained by a CBL tool are eliminated.

SUMMARY OF THE INVENTION

The present invention is in an inflatable packer having a central steel mandrel and an elastomer sleeve on the mandrel movable between a first condition where the inner surface of the sleeve is in contact with the mandrel and a second condition where the outer surface of the sleeve is in contact with the borehole. Means are provided for admitting a cement slurry from the interior of the mandrel to inflate the sleeve from the first condition to the second condition. The length of the mandrel portion underlying the sleeve has intermittent coatings of grit-like particles bonded to the mandrel leaving intermittent bare portions of the mandrel, the intermittent coatings serving to prevent relative axial movement between the sleeve and the mandrel while going into the borehole and the intermittent bare portions of the mandrel serving to affect the sound transmission properties of the mandrel so that a cement bond log can be obtained. The spacing of the intermittent coatings and bare portions of the mandrel is related to the transmitter and receiver of a cement bond logging tool.

DESCRIPTION OF THE PREFERRED EMBODIMENT

Figure 1:
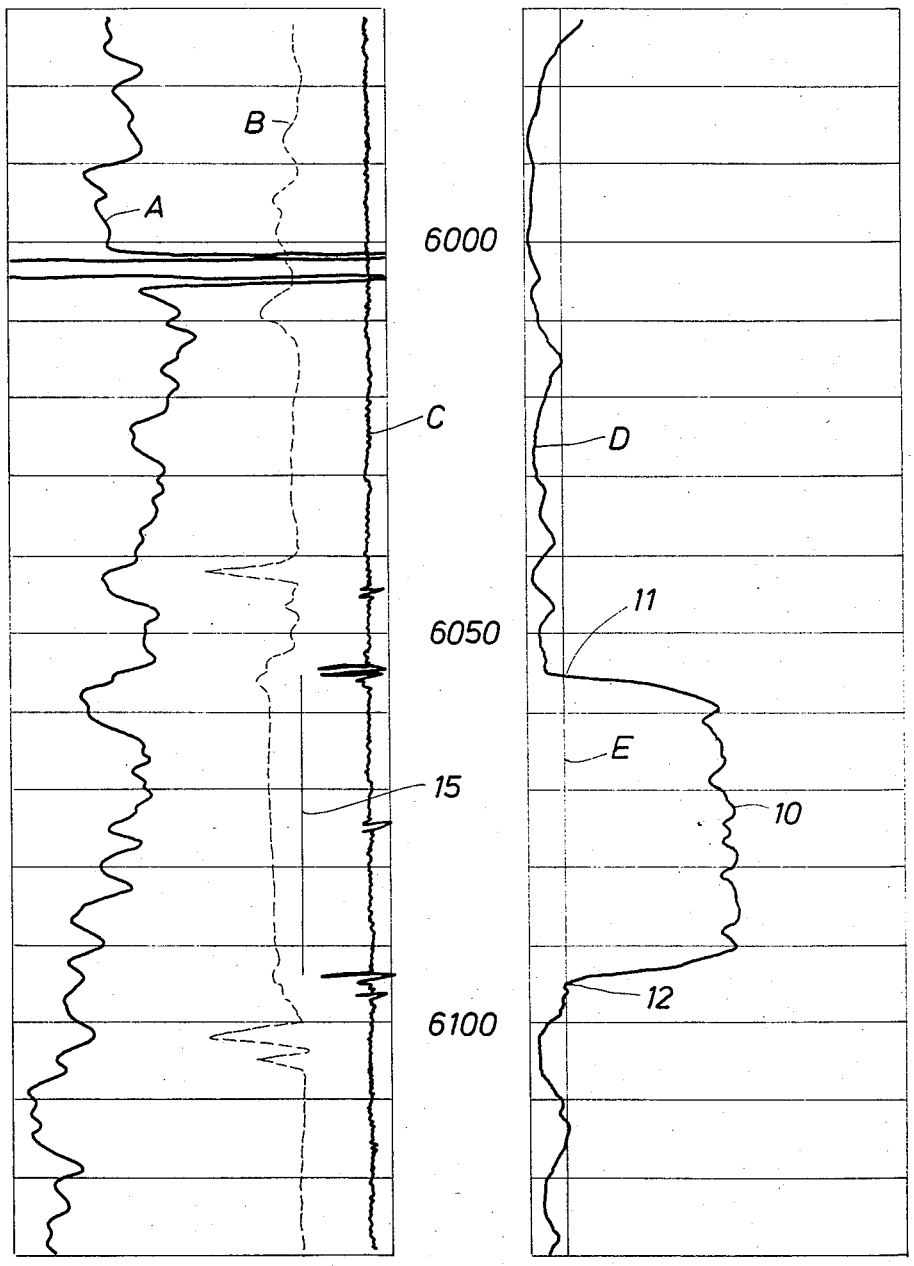
FIG. 1 illustrates a typical cement bond log obtained by a cement bond logging tool in a wellbore containing an inflatable packer with a mandrel having a continuous grit particle coating.

Referring now to FIG. 1, a typical CBL log is illustrated for background purposes. The log is a plot of various measurements made by the tool as a function of depth. Curve A on the log is a typical gamma ray log obtained by a gamma ray tool. Curve B is a travel time log which indicates the $\Delta T$ or time required for a sonic signal to travel through a known length of casing. Curve C is a casing collar log obtained by a magnetic collar locator to indicate collar locations along the length of the string of pipe. On the right hand side of the log, the curve D indicates a plot of the amplitude of the measured sonic signal in a CBL tool and the line E represents the reference line at which the indication of bonding is measured.

As can be appreciated from the log, the curve D at the location 10 indicates a lack of bonding between points 11 and 12 which correspond to the locations of the upper and lower collars of an inflatable packer extending between the depths of 6054' and 6094'. The inflatable packer utilized a continuous epoxy grit coating and thus, the CBL log does not give an indication of the degree of bonding within the inflatable packer.

Referring to a reference line 15 drawn between depths of 6054' and 6094' on the curve B, the reference line 15 illustrates average travel time through a casing or pipe. The sonic travel time in casing as shown by curve B is increased further indicating the effect of the rough coating on the sonic signal. By use of the present invention, the log of travel time obtained by the CBL tool will not be distorted nor the amplitude measurements at location 10 which indicate bonding be disturbed.

Figure 2:
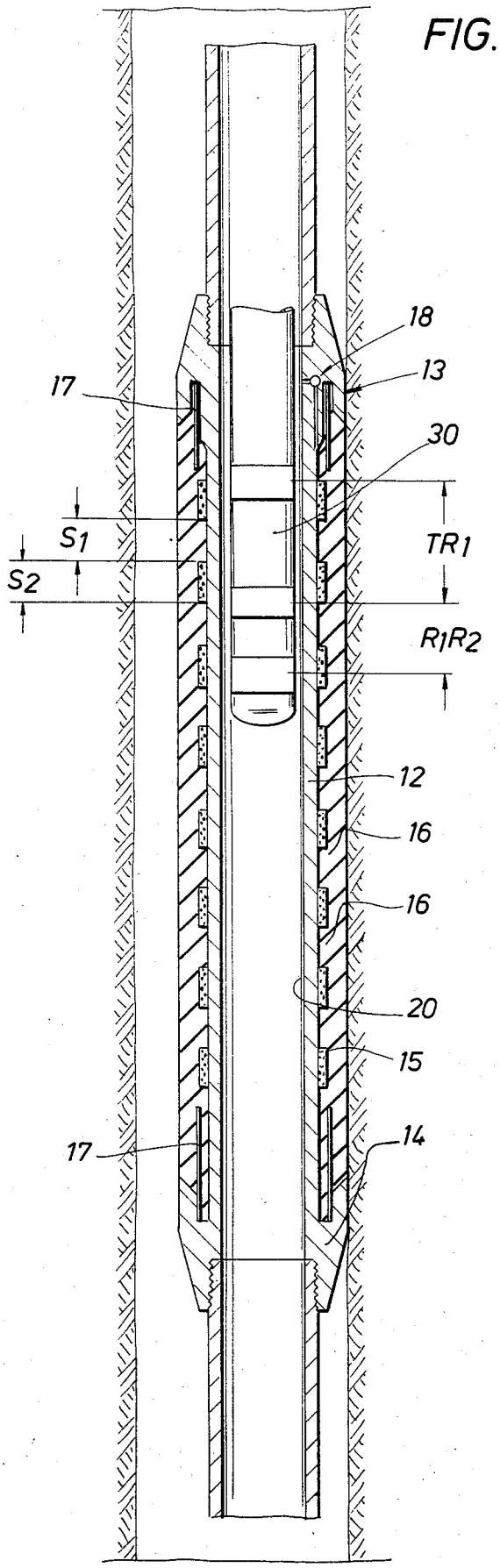
FIG. 2 illustrates a packer constructed in accord with the present invention.

Referring now to FIG. 2, the present invention is illustrated. A tubular mandrel or pipe 12 made of metal or the like provides a support for a tubular sleeve 16 made of a suitable elastomer for use in an oil well. The sleeve 16 is positioned along the length of the mandrel and sealingly fixed to the mandrel 12 at collars 13 and 14. Collar 13 contains a valve system 18 which provides communication of fluid from a bore 20 of the mandrel 12 into an annular space formed between the mandrel and sleeve. The collars 13 and 14 are threadedly and sealingly coupled to a string of pipe above and below the packer. Along the length of the outer surface of the mandrel 12 are intermittent epoxy coatings 15 containing grit-like materials. The coatings 15 are provided in one foot lengths with one foot of spacing between adjacent coatings along the length of the mandrel for reasons which will be made more apparent later. With the rough surface coatings 15 intermittently along the mandrel, while the packer is being lowered into the borehole, the rough surface on the mandrel will prevent the elastomer of the sleeve from shifting or moving with respect to the length of the mandrel. The sleeve 16 is also provided with end ribs 17 which are made of metal or the like and positioned in the upper and lower ends of the sleeve, around and parallel to the mandrel 12 so as to provide end support for the sleeves during and after inflation of the sleeve 16.

Figure 3:
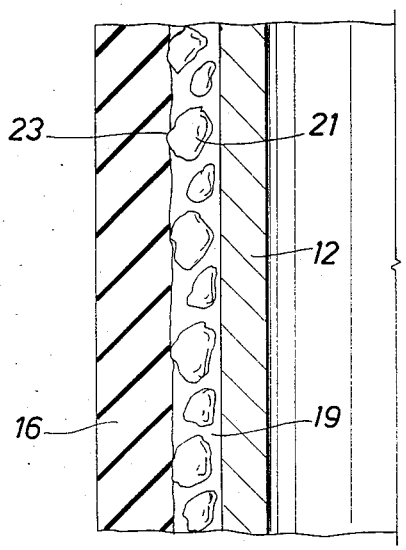
FIG. 3 is an enlarged fragmentary view taken from FIG. 1 to illustrate grit-like particles bonded to the mandrel.

The rough coated surfaces 15 on the mandrel are provided by bonding solid grit-like particles (sand, metal or the like) to the mandrel surface by a suitable binder such as epoxy resin and with a suitable thickness. Thus, as shown in FIG. 3, the outer surface 23 of the epoxy resin 19 has particles of sand or flint 21 mixed with or added thereto so as to provide a sandpaper like roughness to indent the elastomer on the sleeve 16 and to cause the sleeve to adhere to the mandrel while it is being moved through a borehole and thereby prevent damage to the sleeve while its being run into the wellbore.

Referring again to FIG. 2, a CBL tool 30 is illustrated with a transmitter T and receivers R1 and R2. The transmitter to receiver ($TR_1$) spacing is typically three feet and the spacing between receivers R1 and R2 is two feet. By adjusting the length of the rough coatings 15 on the mandrel to one foot and the spacing between the rough coatings 15 to one foot, it can be assured that in any three foot interval between the transmitter there will be at least one foot of uncoated or bare mandrel.

It will be appreciated that the $TR_1$ spacing commonly in use at present is three feet, that this spacing may be varied and thus the spacing of two coating segments and a bare portion on the mandrel may vary accordingly.

In the operation of a CBL, the tool is typically designed to sense a selected peak amplitude at each of the receivers. Heretofore, the presence of a continuous grit-like coating has caused the selected peak amplitude to be increased because of the effect of the continuous epoxy coating. By use of the discontinuous coatings, the bare portion of the mandrel removes the increased effect of the sound transmission in the coating and effectively permits the proper peak amplitude to be sensed. Thus, the advantages of the rough coating to prevent relative axial movement of the sleeve and mandrel are obtained and the packer will not adversely affect a CBL log.

It will be apparent to those skilled in the art that various changes may be made in the invention without departing from the spirit and scope thereof and therefore the invention is not limited by that which is enclosed in the drawings and specifications but only as indicated in the appended claims.

I claim:

1. An inflatable packer for use in a wellbore including a centrally disposed tubular steel mandrel having end means for attachment to a string of pipe;

a tubular expandable sleeve formed from a suitable elastomer and positioned about said tubular mandrel, where the mandrel extends out of the ends of the sleeve;

said sleeve being expandable from a first condition where the inner surface of the sleeve is in contact with the tubular mandrel to a second condition where the outer surface of the sleeve is in contact with a borehole wall;

means for admitting a cement slurry in the interior of the mandrel to the interior between the sleeve and the mandrel for expanding said sleeve from said first condition to said second condition;

said mandrel surface between the ends of said sleeve having intermittent coatings of grit-like materials bonded to the outer surface for contacting the sleeve and for preventing the sleeve in its first condition from moving axially relative to the mandrel while going in a borehole, said intermittent coatings providing uncoated intermittent portions on said mandrel where the spacing between two intermittent coatings and an intermediate uncoated portion on the mandrel are functionally related to the spacing between a transmitter and first receiver of a cement bond logging tool for providing an uncoated section of mandrel relative to a transmitter/receiver spacing on a cement bond logging tool.

2. The apparatus as set forth in claim 1 wherein said intermittent coatings include an epoxy material and particulate materials.

3. The apparatus as set forth in claim 1 wherein the length of each intermittent coating is one foot and the length of each uncoated section is one foot.

* * * * *